US008146549B2

(12) United States Patent
Hoppe et al.

(10) Patent No.: US 8,146,549 B2
(45) Date of Patent: Apr. 3, 2012

(54) FEEDER FOR A CAMSHAFT ADJUSTER

(75) Inventors: Jens Hoppe, Erlangen (DE); Ali Bayrakdar, Rothenbach/Pegnitz (DE); Gerhard Scheidig, Nuremberg (DE)

(73) Assignee: Schaeffler Technologies GmbH & Co. KG, Herzogenaurach (DE)

( * ) Notice: Subject to any disclaimer, the term of this patent is extended or adjusted under 35 U.S.C. 154(b) by 908 days.

(21) Appl. No.: 12/096,958

(22) PCT Filed: Nov. 29, 2006

(86) PCT No.: PCT/EP2006/069027

§ 371 (c)(1),
(2), (4) Date: Jun. 11, 2008

(87) PCT Pub. No.: WO2007/068586

PCT Pub. Date: Jun. 21, 2007

(65) Prior Publication Data

US 2008/0264200 A1 Oct. 30, 2008

(30) Foreign Application Priority Data

Dec. 16, 2005 (DE) ..... 10 2005 060 111

(51) Int. Cl.
*F01L 1/34* (2006.01)

(52) U.S. Cl. ..... 123/90.17; 123/90.33

(58) Field of Classification Search ..... 123/90.17, 123/90.33, 90.34; 184/6.24
See application file for complete search history.

(56) References Cited

U.S. PATENT DOCUMENTS

| | | | | |
|---|---|---|---|---|
| 5,113,814 | A | 5/1992 | Suga et al. | |
| 5,794,578 | A * | 8/1998 | Strauss et al. | 123/90.17 |
| 2005/0045129 | A1 | 3/2005 | Bu | |

FOREIGN PATENT DOCUMENTS

| | | |
|---|---|---|
| DE | 19623818 | 12/1996 |
| DE | 19930711 | 8/2000 |
| DE | 19944535 | 1/2001 |
| DE | 10050225 | 4/2002 |
| DE | 102004035035 | 3/2005 |
| EP | 0590696 | 4/1994 |
| EP | 0806550 | 3/1997 |
| EP | 1284340 | 2/2003 |
| EP | 1291563 | 3/2003 |

* cited by examiner

*Primary Examiner* — Thomas Denion
*Assistant Examiner* — Daniel Bernstein
(74) *Attorney, Agent, or Firm* — Volpe and Koenig, P.C.

(57) ABSTRACT

A feeder for a camshaft adjuster is provided, including a central screw, a camshaft, and at least one flow resistance element. The camshaft is provided with a bore for accommodating the central screw. A channel is located between the camshaft and the central screw, in which the flow resistance element is provided in order to affect a flow of a fluid in the channel.

19 Claims, 5 Drawing Sheets

FEEDER FOR A CAMSHAFT ADJUSTER

BACKGROUND

The present invention relates to the field of hydraulics. In particular, the present invention relates to a feeder for a camshaft adjuster, the use of a flow resistance element in a feeder for a camshaft adjuster, a camshaft adjustment device with a feeder for a camshaft adjuster, and a flow resistance element.

Camshafts with their cams are used in an internal combustion engine for the purpose of opening gas-exchange valves against the force of valve springs, wherein these gas-exchange valves are designed for pushing out the combusted gases and drawing in fresh gases separately. Rigid control times for the valves always represent a compromise in design with respect to the achievable maximum force or torque and its position in the usable rotational speed band, as well as the achievable output at nominal rotational speed.

Therefore, rotating camshafts have been developed, which can change the control times for the valves through rotation of the camshaft depending on the engine rotational speed. Such a hydraulically operated device for variable adjustment of the control times of an internal combustion engine, a so-called camshaft adjuster, is known, for example, from EP 0 806 550 or DE 196 23 818.

During the operation of the internal combustion engine, alternating moments act on the camshaft, which appear, for example, through friction forces in the contact of the cams with the closing valves. These alternating moments are generated through the rolling of the cams on the cam followers, for example, compensation elements, for compensating the valve lash. The pressure spikes generated by the alternating moments are described, for example, in EP 0 590 696.

The pressure spikes are generated in the pressure chambers of the camshaft adjuster and can lead to the undesired result that the actual chamber to be pressurized is partially evacuated for the period of the pressure spike. The adjustment speed, with which a camshaft can be adjusted to an advanced or retarded position, decreases and the phase alignment is negatively affected. In addition, the pressure spikes are also transmitted to other pressure consumers that could therefore become damaged.

It is known to integrate non-return valves in the external pressure circuit or in the external pressure line of the camshaft adjuster. Examples here can be taken from EP 0 590 696, EP 1 291 563, or EP 1 284 340.

A central valve that is integrated in the screw for the camshaft attachment is known, for example, from DE 199 44 535 C1.

SUMMARY

An object of the present invention is to provide an improved feeder for a camshaft adjuster.

Accordingly, a feeder for a camshaft adjuster, a use of a flow resistance element in a feeder for a camshaft adjuster, a camshaft adjustment device, and a flow resistance element will be specified.

According to one embodiment of the present invention, a feeder for a camshaft adjuster is provided. The feeder for a camshaft adjuster comprises a central screw and a camshaft with a bore, wherein the central screw is arranged at least partially in the bore. The central screw is arranged in the bore of the camshaft in such a way that a gap is produced, through which a fluid can flow, between the central screw and the bore. In the formed gap, at least one flow resistance element is arranged, wherein the one or more flow resistance elements at least partially act against a direction of flow that the fluid exhibits.

Through the use of the flow resistance element, the flow behavior of the fluid in the gap can be influenced. The influence of the flow behavior can here also consist in that a flow direction of the fluid can be completely interrupted. Thus, the flow direction of the fluid can be controlled.

The bore can be arranged, for example, in an end region of the camshaft. Thus, the bore can have a blind hole-like configuration.

According to another embodiment of the present invention, the use of a flow resistance element in a feeder for a camshaft adjuster will be specified. The flow resistance element here can be inserted into a gap between the bore of the camshaft and the central screw of the camshaft, in order to act against fluid movement.

For stopping or negatively affecting the flow direction of the fluid, the flow resistance element can fill up and thus seal the cross section of the gap or a projection of this gap.

According to yet another embodiment of the present invention, a camshaft adjustment device is specified. The camshaft adjustment device here comprises a feeder for a camshaft adjuster and a phase adjustment device, wherein the feeder for the camshaft adjuster is configured to charge the phase adjustment device with a fluid. Thus, a fluid flow of the phase adjustment device can be influenced in its flow behavior. Thus, for example, it can be determined whether and how much fluid should be provided to the phase adjustment device.

According to another embodiment, a flow resistance element is specified, wherein the flow resistance element has a flow resistance body, which can extend in the radial direction in a gap between the boundaries of the gap. Here, the boundaries can be formed, for example, by a bore in a camshaft and a central screw. The flow resistance element has a flow resistance body, with which it acts against a fluid movement in a gap.

According to another embodiment of the present invention, a feeder for a camshaft adjuster is provided, wherein the gap between the central screw and the bore is configured as an annular gap.

The central screw can be arranged coaxial in a correspondingly configured bore of a camshaft, so that between the camshaft and the central screw an annular or circular spacing is produced. This spacing or gap, in particular, annular gap, can be used, in order to be able to charge a camshaft adjustment device with a fluid via the gap. The gap formed in cross section as a ring can extend axis-parallel along the length of the central screw. Consequently, the gap can be configured like a cylinder in the shape of a ring along the length of the central screw.

Furthermore, according to another embodiment of the present invention, a feeder for a camshaft adjuster is provided, wherein the central screw and the camshaft are configured so that they can rotate opposite each other. Therefore, for fixing during assembly, for example, a central screw can be screwed into a camshaft or into a bore of a camshaft. The flow resistance element here does not prevent the rotation of the central screw relative to the camshaft produced during the screwing-in process. However, the flow resistance element can be configured to compensate for tolerance deviations that could appear when the central screw is inserted into the bore.

According to another embodiment of the present invention, a feeder for a camshaft adjuster is specified, wherein the central screw has a defined outer periphery and wherein the flow resistance element is arranged on the outer periphery of the central screw. Thus, the one or more flow resistance elements can be mounted on the outer periphery of the central screw in such a way that it forms a fixed, one-piece unit with the central screw. Thus, the installation position of the flow resistance element can be fixed.

In addition, through a flow resistance element arranged on the outer periphery of the central screw, the flow resistance element can be easily accessed for the disassembly of the central screw. This can be helpful, for example, for troubleshooting or replacement of the flow resistance element.

According to another embodiment of the present invention, a feeder for a camshaft adjuster is specified, wherein the one or more flow resistance elements surround the outer periphery of the central screw like a collar. Through the collar-like surrounding of the outer periphery of the central screw with a flow resistance element, a secure and complete enclosure or sealing of the outer periphery of the central screw can be realized.

In addition, according to another embodiment of the present invention, a feeder for a camshaft adjuster is provided, in which the bore in the camshaft or in one end of the camshaft has an inner periphery, in which the flow resistance element is arranged. The arrangement of a flow resistance element in an inner periphery of the bore can represent an additional guide for the assembly of a central screw in the bore.

According to another embodiment of the present invention, a feeder for a camshaft adjuster is provided, wherein the flow resistance element extends in the radial direction between the inner periphery of the bore and the outer periphery of the central screw.

Here, the flow resistance element can extend in the radial direction either from the outer periphery of the central screw up to the inner periphery of the bore or also from the inner periphery of the bore to the outer periphery of the central screw. In connection with this text, extension in the radial direction should also be understood to be extension in the radial direction at an angle, in which only one directional component is actually radial, while the other directional component extends in the axial direction. In other words, this means an extension of the flow resistance element, whose projection, viewed toward the gap cross section, extends in the radial direction.

Consequently, this definition of extension in the radial direction can also include an arrangement of the flow resistance element extending in the gap at an angle from the outer periphery of the central screw to the inner periphery of the bore or else also an extension extending at an angle from the inner periphery of the bore to the outer periphery of the central.

The radial arrangement of the flow resistance element in a gap can have the result that on the projection of the flow resistance element viewed toward the cross-section, the circular gap formed between the outer periphery of the central screw and the inner periphery of the bore is completely covered or sealed by the flow resistance element. Consequently, the flow resistance element contacts both the inner periphery of the bore and also the outer periphery of the central screw. If necessary, the sealing effect can be improved by providing bores or shoulders or raised sections or milled sections on the inner periphery of the bore or the outer periphery of the central screw.

Furthermore, according to another embodiment of the present invention, a feeder for a camshaft adjuster is provided, wherein the flow resistance element has a replaceable configuration. Consequently, the flow resistance element can be removed and replaced, for example, when worn. However, a region in the vicinity of the flow resistance element can also be easily cleaned.

According to yet another embodiment of the present invention, a feeder for a camshaft adjuster is provided, wherein the camshaft, in particular, the end of a camshaft, has a supply opening, which opens into the bore of the camshaft. Through this supply opening (a so-called port or also pressure-oil supply) the bore can be charged with a fluid from an outer region of the camshaft. In the outer region, the feeding of the fluid can be realized, for example, by external pressure lines.

Because the supply opening opens simultaneously into the annular gap between the central screw and the bore, the gap thus can be charged with a fluid. Through the pressure, with which the fluid is provided via the supply opening, an internal pressure of the fluid can be generated in the gap or the supply channel provided between the central screw and the bore of the camshaft. Therefore, the pressure of the fluid can be defined in a device to be supplied via the feeder for a camshaft adjuster.

According to yet another embodiment, a feeder for a camshaft adjuster is provided, wherein the central screw has an axis that defines an axial direction for the central screw. The flow resistance element arranged in the gap between the central screw and the bore is here configured in such a way that it acts against a direction of flow of the fluid pointing in the axial direction. Consequently, the flow behavior of the fluid can be influenced by the flow resistance element along the axis of the central screw, in particular, in a channel constructed between the central screw and the bore of the camshaft. Thus, pressure can be reduced or built up or the direction of flow of the fluid can be influenced.

Furthermore, according to another embodiment of the present invention, a feeder of the camshaft adjuster is specified, wherein the one or more flow resistance elements are configured to act against the direction of flow of the fluid pointing in the axial direction with a resistance different than a flow direction pointing opposite the axial direction.

Consequently, it can be achieved that the fluid can indeed propagate nearly unimpaired in a direction along the axis of the central screw, while it is prevented from propagation in the opposite direction. Thus forward flow is allowed but backward flow is prevented.

Furthermore, according to another embodiment of the present invention, a feeder for a camshaft adjuster is provided, wherein the flow resistance element acts as a non-return valve. Here, the flow resistance element can be arranged in the gap in such a way that it can flow in a direction designated, for example, as the forward direction, within a line system between the inner periphery of the bore of the camshaft and the outer periphery of the central screw, whereas a fluid flow in a backward direction defined accordingly in the opposite direction is almost completely stopped.

According to other embodiments of the present invention, the non-return valve can be configured as an annular slide, as a fan-shaped spring, as a profiled elastomer, or as a flow-activated, annular closing body.

An annular slide can be, for example, a sliding element made from steel, which opens against the pressure of a screw spring or zigzag spring in one direction, but flow can be prevented in another direction supported by the corresponding spring. A fan-shaped spring can be a leaf spring, in which a spring effect is achieved by the biasing of individual leaves.

A profiled elastomer ring can be configured, due to the profiling, in such a way that it can be folded open due to a pressure. However, if the elastomer ring contacts a contact surface, then an opening can be closed.

A flow-activated annular closing body can be made, for example, from a thermoplastic. A non-return valve can stop one direction of movement and can therefore generate a closing function independent of the construction. The closing function can be performed against a structural space or against a stop integrated in the valve, in particular, a flange or a shoulder or milled section.

According to yet another embodiment of the present invention, the flow resistance element can be configured to function as a filter element. The resistance, which can act against a fluid movement, can be realized by openings, in particular, small openings of a sealing component. The sealing component can be arranged in the gap in such a way that it would completely seal the cross section of the gap when it would have no openings that are permeable for the molecules of the fluid.

For particles, for example, contaminants, that are larger than the diameter in the filter element, passage through the filter element can be prevented. Thus, dirt, contaminants, and undesired foreign bodies can be filtered out. Due to the barrier-like effect, the filter element can act as a filter resistance for the fluid. For example, through the selection of the size of the passage openings, this resistance can be set. Thus, it can be prevented that contaminant particles, viewed in one flow direction, collect in a region arranged behind the filter. This region thus can be kept free from contamination.

Furthermore, according to other embodiments of the present invention, constructions of a filter are specified. A filter can be produced as an annular filter plate, for example, photochemically etched or lased. A filter can be produced as a funnel-shaped filter screen, wherein a filter screen can have a large surface area. The production can also be realized by photochemical etching or lasing. Furthermore, the filter can be produced as an annular filter, for example, as a steel filter fabric, as an insert part made from thermoplastic material. Here, the thermoplastic material can be provided for a seal, while the steel filter fabric can take over the filter function. In addition, the filter can be constructed as a funnel-shaped filter screen, wherein a large surface area can also be provided.

In the preceding sections, some improvements of the invention were described with reference to the feeder for a camshaft adjuster. These constructions also apply for the use of a flow resistance element of a feeder for a camshaft adjuster and for the camshaft adjustment device.

Additional advantageous embodiments can be viewed as separate components in the combination of flow resistance elements; for example, the combination of a non-return valve can be realized with a filter as a standalone component.

On the other hand, the flow resistance element can be integrated in a component, which contains a non-return valve and a filter in one unit. This unit can be integrated rigidly on the central screw. The combination of non-return valve and filter, however, can also be arranged detachably on the central screw.

The arrangement of filter and non-return valve can also be realized using different means and ways. Thus, first the filter can carry a flow, wherein any contaminants or any dirt is retained and therefore cannot propagate to a non-return valve lying downstream in the direction of flow. Thus failure of the non-return valve can be prevented. Also conceivable, however, is the reverse case, i.e., that viewed in the direction of flow, first the non-return valve is arranged followed by the filter. Here, the non-return valve, however, cannot be protected from contaminants.

BRIEF DESCRIPTION OF THE DRAWINGS

In the following, advantageous embodiments of the present invention will be described with reference to the figures.

DETAILED DESCRIPTION OF THE PREFERRED EMBODIMENTS

The illustrations in the figures are schematic and not to scale. In the following description of FIGS. 1 to 10, identical reference symbols are used for identical or corresponding elements.

Figure 1:
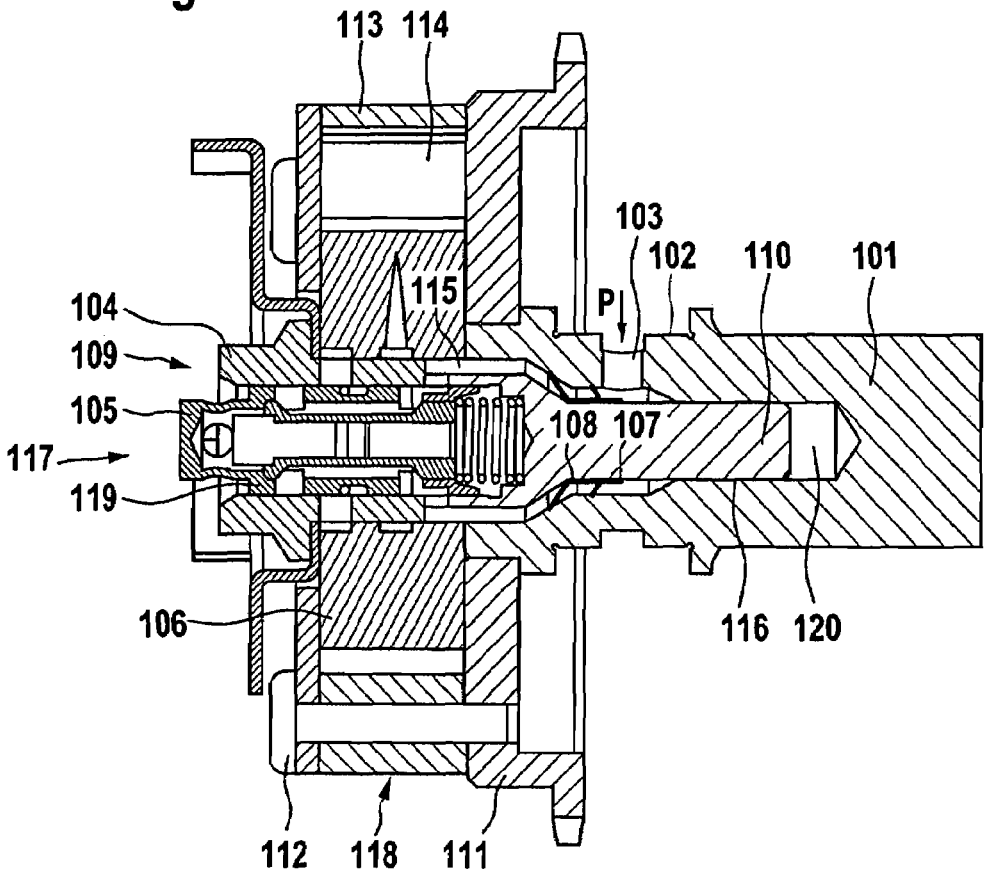
FIG. 1 shows a longitudinal section view through the camshaft adjustment device with a feeder for a camshaft adjuster according to one embodiment of the present invention.

FIG. 1 shows a longitudinal section through a camshaft adjustment device with a feeder for a camshaft adjuster according to one embodiment of the present invention. The camshaft adjustment device 117 comprises a feeder for a camshaft adjuster and the phase adjustment device 118. The phase adjustment device 118 comprises, among other things, the side housing 113 and the camshaft adjuster 106. The chain ring 111 is connected rigidly via screws 112 to the side housing 113. Thus, the side housing 113 follows the rotation of the chain ring 111 in-phase. Rotation is realized about the axes of the camshaft 101 and the central screw 109.

In the side housing 113, hydraulic chambers 114 are formed between the boundaries of the side housing 113 and the chain ring 111. The camshaft adjuster 106 or vane rotors 106, which can be rotated in the opposite direction or in the side housing 113 by a rotational angle relative to the chain ring 111, project into these hydraulic chambers 114. This rotation is achieved through a corresponding pressurization of the hydraulic chambers 114, which will not be discussed in more detail here.

The camshaft adjuster 106 is connected rigidly both to the central screw housing 104 and also to the camshaft 2, in particular, one end of the camshaft. A unit formed from the central screw 109, the camshaft adjuster 106, and the camshaft 101, can therefore be rotated by an angle relative to the chain ring 111. The cams arranged on the camshaft 101, however, are not shown in FIG. 1, but thus can be adjusted in their phase position, relative to the rotation of the chain ring 111. Thus, advanced or retarded opening or closing of the gas-exchange valves, on which the cams of the camshaft act, can be achieved.

The central screw 109 comprises a central screw housing 104 and the central screw shaft 110. The central screw housing 104 includes the central valve 119 not explained in more detail. For pressurizing the hydraulic chambers 114, a fluid, in particular, an oil, must be provided at a certain pressure to the hydraulic chamber 114. For this purpose, the end of the camshaft 101 is provided with a bore 120.

The bore 120 extends in the end region of the camshaft 101 and has, in some sections, a different construction. In a first region 116, the bore of the camshaft is provided with a thread, in which the shaft 110 of the central screw 109 also provided with a thread can be screwed. In the threaded region 116, the inner periphery of the bore 120 is adapted to the outer periphery of the shaft 110.

At the end of the camshaft 101, the chain ring 111 is mounted so that it can rotate on the outer diameter of the camshaft 101. In a region of the bore 120, which lies between the region 116 provided with the thread and the end of the camshaft 101, the inner diameter of the bore 120 has a larger extent than the outer diameter of the shaft 110 of the central screw 109. Therefore, between the central screw 109 and the bore 120, an annular gap 115 is formed, which extends in the axial direction of the central screw 109. This gap 115 follows the shape of the outer diameter of the central screw 109 in the region, in which the central screw 109 is integrated into the camshaft 101. The outer diameter of the central screw 109 expands relative to the outer diameter of the shaft 110 in the region of the central screw housing 104, which comprises the central valve 119.

The gap 115 reaches from the region 116, in which the shaft 110 of the central screw is screwed into the bore 120, up to the part of the central screw housing 104, on which the central screw housing 104 is connected rigidly to the camshaft adjuster 106 and is partially bounded instead by the bore 120 of the camshaft adjuster 106.

A pressurized oil supply P 103 is arranged in the radial direction in the camshaft 101 in a region between the part 116 of the bore 120 provided with a thread and the end of the camshaft 101. This pressurized oil supply P 103 or bore 103, which is arranged on the radial bearing 102 of the camshaft, allows the gap 115 to be charged with oil via a pressure line system not described in more detail.

The bore 103 of the pressurized oil supply opens into the bore 120 of the camshaft and thus into the gap 115 between the outer periphery of the central screw 109 and the inner periphery of the bore 120 of the camshaft 101. Thus, the oil, which appears at the radial bearing of the camshaft 102 via the pressurized oil supply P 103, is guided or deflected in the axial direction coming from the direction of the camshaft 101 along the shaft 110 or the central screw housing 104 into the axial direction of the camshaft adjuster 106.

The oil is charged into the hydraulic chamber 114 by the pressure in the central valve 119, which is configured as a 4/3 directional, proportional control valve within the inner rotor of the camshaft adjuster 106. A circular filter 107 and/or a non-return valve 108 is arranged in the gap 115 between the inlet of the pressurized oil supply P 103 and an extension of the central screw shaft 110 to the central screw housing 104. The extension to the central screw housing 104 rises linearly and is used for accommodating the central valve 119. The shape of the bore 120 follows the linear rise of the central screw 109, so that the spacing of the central screw from the inner diameter of the bore remains constant along the length of the gap.

Figure 2:
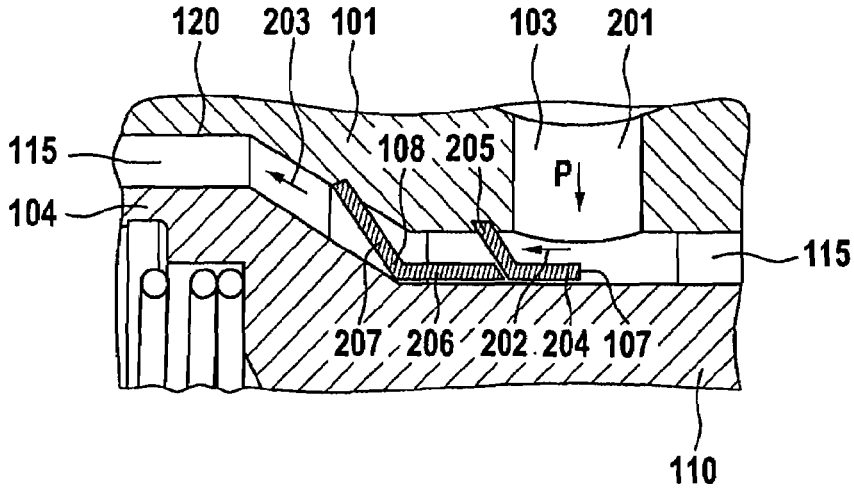
FIG. 2 shows an enlarged longitudinal section view of a flow resistance element arranged in a gap in a feeder for a camshaft adjuster according to another embodiment of the present invention.

The filter 107 and the non-return valve 108 are explained in more detail in FIG. 2. FIG. 2 shows an enlarged longitudinal section diagram of a flow resistance element lying in the gap 115, in particular, a filter 107 and a non-return valve 108 of a feeder for a camshaft adjuster, according to an embodiment of the present invention. FIG. 2 shows, in sections, a region of the camshaft adjustment device 117. Partly shown is the camshaft 101 with the pressurized oil supply 103 and a section of the central screw shaft 110 and the central screw housing 104 of the central screw 109. The supply with the fluid is realized in FIG. 2 from above via the pressurized oil supply 103.

It is to be seen that for the transition of the central screw shaft 110 to the central screw housing 104, the outer periphery of the central screw 109 increases in the axial direction in the region of the central screw housing 104 relative to the outer periphery of the central screw shaft 110. Through the pressurized oil supply 103, in the radial direction 201, pressurized oil is fed to the circular ring gap 115. The circular ring gap 115 is formed due to the smaller outer diameter of the central screw shaft 110 or the central screw housing 104 with respect to the inner diameter of the bore 120 in the camshaft 101.

As seen from FIG. 2, the oil stream 201 introduced in the radial direction is deflected in a direction 202 lying in the axial direction in the direction of lower pressure. Here, the pressure difference of the oil pressure is so large that the oil flows through the rigid filter 107 and the oil propagates past the non-return valve 108 in the direction 120 of the central screw housing 104. This situation can be realized, for example, when a pressure chamber lying on the side of the circular ring gap 115 away from the pressurized oil supply 103 is to be filled with oil. It then creates a lower pressure at this remote end than at the pressure supply 103.

The filter 107 surrounds the shaft 110 with a collar-like configuration. In the section view of FIG. 2, the filter 107 has two legs. With the first leg 204, the filter 107 is arranged on the outer diameter of the central screw shaft 110. The second leg 205 of the filter 107 extends at an angle in the radial direction in the direction of the inner diameter of the bore in the camshaft 101, where it is fixed or forms a contact in a milled section. The second leg 205 of the filter 107 has openings, through which the oil can penetrate, wherein, however, contaminants remain behind in the region of the circular ring gap 115 in the vicinity of the pressurized oil supply 103. This second leg 205 forms the flow resistance body of the flow resistance element 107.

The non-return valve 108 surrounds the shaft 110 also with a collar-like configuration and also has in the section illustration from FIG. 2 a first leg 206 and a second leg 207. The second leg 207, however, can move relative to the first leg 206, with which the non-return valve is arranged on the outer diameter of the shaft 110. That is, in this way the obtuse angle formed between the first leg 206 and the second leg 207 can be enlarged when a fluid flows in the direction 203.

The second leg 207 of the non-return valve 108 projects in the radial direction into the circular ring gap 115, by which a projection surface of the cross section of the circular ring gap 115 is sealed completely with the second leg 207 of the non-return valve 108. In this way, the second leg 207 forms the flow resistance body of the flow resistance element 108. The obtuse angle between the first leg 206 and second leg 207 of the non-return valve is increased relative to a restoring force, with which the second leg 207 is pressed onto the inner periphery of the bore in the camshaft 101.

The non-return valve 108 is arranged in the circular ring gap 115 in such a way that, when a fluid propagates in a direction opposite the direction 203 shown in FIG. 2, the second leg 207 of the non-return valve 108 is pressed against the inner periphery of the bore of the camshaft 101 in such a way that propagation of the fluid in this opposite direction is not possible. Thus it can be achieved that the fluid coming from the pressurized oil supply 103 propagates in the direction 202 and direction 203 into, for example, a hydraulic chamber, which is not shown in FIG. 2. However, the sealing via the second leg 207 of the non-return valve 108 can also prevent flow in the direction opposite the direction 203 and in the direction opposite the direction 202.

Such a restoring force of the oil could be generated, for example, by alternating moments produced when the cams roll on cam followers. Through sealing by the non-return valve 108, undesired negative effects due to pressure spikes can be prevented. For example, pressure spikes could be produced in the pressure chambers or hydraulic chambers of the camshaft adjuster 106. It can also be avoided that the hydraulic chambers 114 become at least partially emptied, which is undesired.

Clearly this means that the non-return valve 108 or the filter 107 can be used in central valves 119 for the camshaft adjustment of internal combustion engines, whose pressurized oil supply P 103 comes in the axial direction from the direction of the camshaft 101. The oil appearing at the radial bearing 102 of the camshaft 101 is deflected along the shaft 110 and the central screw housing 104 in the axial direction 204, 203 toward the camshaft adjuster 106. Here, the oil flows through a circular ring gap 115 between the central screw shaft 110 and the bore 120 in the camshaft 101.

Through the attachment of a circular filter 107 and/or a non-return valve 108, the performance of the camshaft adjustment system 117 can be influenced. The central valve 119 is integrated into the central screw 109 for attachment to the camshaft. The filter 107 or the non-return valve 108 can reduce susceptibility to contaminants and can improve the performance of the adjustment speed and controllability. Thus, for camshaft adjustment applications, the robustness relative to contaminants can be increased through the introduction of a filter 107 in the pressurized oil supply P 103.

The implementation of a non-return valve 108 improves, in certain operating points of an internal combustion engine, the performance of a camshaft adjuster 106. Especially at high temperatures, with corresponding low oil viscosity, and at low engine rotational speeds, the pressure in the oil supply 103 and thus the controllability or adjustment speed is limited. In addition, no-load operation of the camshaft adjuster 106, 118 in the shutdown state can be prevented by the non-return valve 108.

In addition to the separate arrangement of the non-return valve 108 and filter 107 shown in FIG. 2, it is also conceivable to integrate the non-return valve and the filter integrated into a unit rigidly on the central valve screw 109, in particular, the screw shaft 110. In addition, it is possible to arrange the non-return valve and the filter integrated into a unit detachably on the central valve screw 109.

The arrangement of filter 107 and non-return valve 108 can be realized in various ways: viewed in the direction of flow 204, 203, fluid can flow first through the filter, by means of which any contaminants are captured and therefore cannot lead to the failure of the non-return valve. The reverse case is also conceivable, however, i.e., that the non-return valve is arranged first and then the filter. Here, however, the non-return valve 108 is not protected against contaminants.

Figure 3:
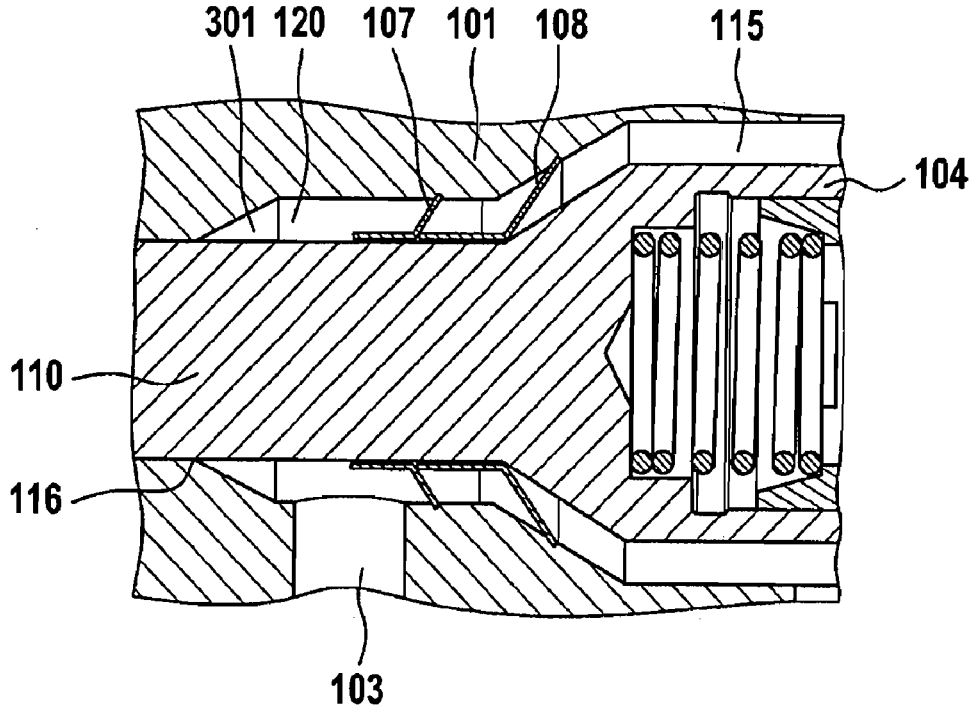
FIG. 3 shows another enlarged longitudinal section view of a flow resistance element arranged in a gap in a feeder for a camshaft adjuster according to another embodiment of the present invention.

FIG. 3 shows another enlarged longitudinal section illustration of a flow resistance element lying in a gap in a feeder for a camshaft adjuster according to one embodiment of the present invention. FIG. 3 shows that starting at a region 301 in the direction of the screw housing, the shaft 110 is no longer screwed into the thread 116 of the bore 120. Instead, in region 301 the inner periphery of the bore 120 expands relative to the outer periphery of the shaft 110, by means of which the circular gap 115 is formed. FIG. 3 shows that the non-return valve 108 and the filter 107 are supported with a cone shape against the surrounding construction 101.

Figure 4:
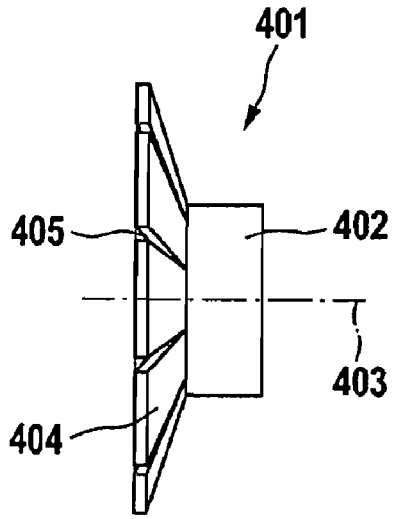
FIG. 4 shows a side view of a flow resistance element according to another embodiment of the present invention.

FIG. 4 shows a side view of a flow resistance element according to one embodiment of the present invention. The flow resistance element shown in FIG. 4 is a non-return valve 401. FIG. 4 shows the collar-like radial configuration of the non-return valve 401. The non-return valve 401 has a cylindrical collar 402, with which it can be mounted on the shaft 110 or the housing 104 of a central screw 109. The inner diameter of the cylinder 402 here corresponds to the outer diameter of the shaft. Therefore, a tight contact on the shaft can be achieved.

The plates 404 extend in the radial direction, pointing away from the axis 403, wherein a spring effect of the non-return valve can be generated with the effect of the plates. For this purpose, slots 405, which allow movement of the individual plates, are provided between the plates 404. The plates run at an obtuse angle from the outer periphery of the cylinder 402 away from the axis 403. By applying a force, the obtuse angle can be further increased, by means of which a restoring force can be generated due to the spring effect of the leaf springs 404. The ends of the plates 404 away from the axis 403 can contact, for example, the inner periphery of the outer bore 120 of the camshaft 101. In the installation, axial tolerances can be compensated by the spring mounting of the components 404.

Figure 5:
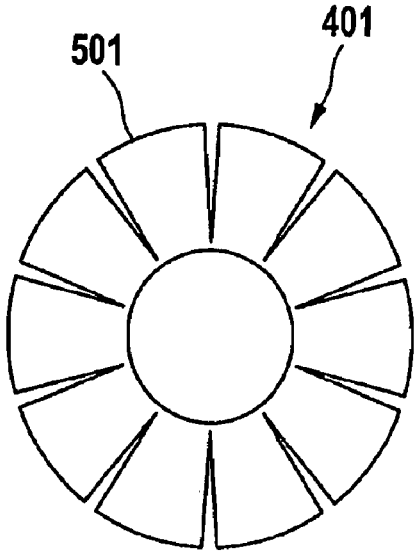
FIG. 5 shows a front view of a flow resistance element according to yet another embodiment of the present invention.

FIG. 5 shows a front view of a flow resistance element according to the present invention. This is the front view of the non-return valve of FIG. 4. To be taken from FIG. 5 is here the outer diameter 501, with which the non-return valve 401 can be supported on the inner periphery of a bore. The outer diameter is essentially a circle concentric to the inner cylinder 402. With the non-return valve 401, a circular ring gap can be sealed, whose extent reaches from the diameter of the tubular collar 402 to the outer diameter of the plates 501.

Figure 6:
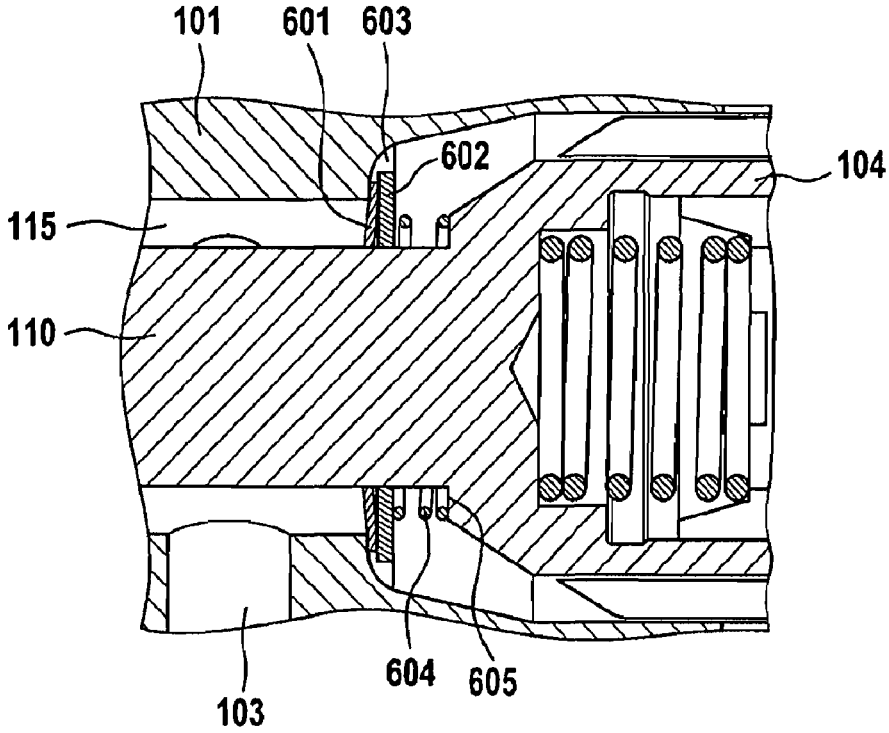
FIG. 6 shows another embodiment of a flow resistance element according to another embodiment of the present invention.

FIG. 6 shows another embodiment of a flow resistance element according to one embodiment of the present invention. In FIG. 6, shapes that have been changed relative to FIG. 3 both of the central screw shaft 110 and also the bore of the camshaft 101 are to be seen. The inner diameter of the bore does not have a consistently rising configuration as in FIG. 3, but instead a ring shoulder with a step 603 is formed in the inner diameter. Accordingly, a ring shoulder 605 is formed at the transition region between the shaft 110 and the central screw housing 104.

On the ring shoulder 605, the pressure spring 604 finds a stop. The filter 601 and the non-return valve 602 are arranged on the shaft of the central screw 110 in the radial direction. While the filter 601 is fixed on the shaft and the stop 603, the non-return valve 602 can be moved in the axial direction parallel to the axis of the shaft 110. The spring 604 presses the non-return valve 602 against the step 603. If the gap 115 is charged with a fluid in the direction of the central screw housing, then the non-return valve can open the gap 115 for the passage of a fluid against the restoring force of the pressure spring 604.

For decreasing pressure from the pressurized oil supply 103 and, in particular, for a pressure inversion, the non-return valve 602 is pressed against the ring shoulder 603 in such a way that the resistance acting against the fluid is so high that no oil can pass in the direction of the oil supply 103. The filter 601 prevents contaminants from reaching from the side of the pressurized oil supply 103 in the direction of the central screw housing 104. The non-return valve 602 and the filter 601 form a seal flat against the shoulder 603. The spring effect is generated by the coil pressure spring 604. By spring-mounting the components, in particular, the flow resistance elements 601, 602, axial tolerances are compensated.

Figure 7:
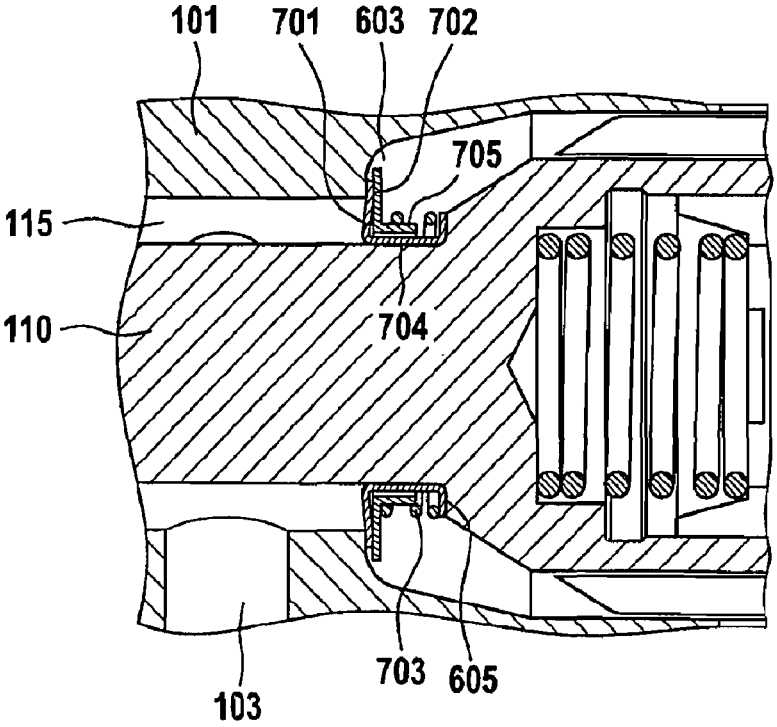
FIG. 7 shows yet another embodiment of a flow resistance element according to yet another embodiment of the present invention.

FIG. 7 shows yet another embodiment of a flow resistance element according to one embodiment of the present invention. The filter element 701 has a U-shaped longitudinal section. It comprises a tubular or cylindrical collar 704, with which it is connected rigidly to the outer diameter of the shaft 110. The collar 704 here extends under the spring 703. The collar 704 simultaneously provides a contact surface for the tubular contact 705 of a non-return valve 702. The non-return valve 702 is configured with an L-shaped longitudinal section and has two right-angled legs. While one leg forms the tubular contact 705, the other leg is configured for sealing the gap 115. The non-return valve 702 here functions as a valve slide, i.e., as an element that produces the sealing function through sliding.

The contact 705 is arranged movable in the axial direction on the cylinder 704 of the filter element 701 beneath the spring 703, i.e., it is located between the spring and the cylinder 704. The filter element 701 is supported with one end region of the cylinder 704 on the shoulder 605 of the shaft 110, so that it cannot move and acts against resistance for only fluid flowing through the channel 115 through its filter component pointing outward in the radial direction.

This filter component pointing outward in the radial direction forms a tight contact on the shoulder 603. The contact 705 can be moved together with the right-angled step of the non-return valve in the axial direction in the direction of the central screw housing. For this purpose, a sufficiently high pressure difference is required, similar to that explained farther above. When the pressure decreases, through the force of the spring, the non-return valve 702 is pressed both against the filter element 701 and also against the step 603, via which the channel 115 is closed tightly.

The filter 701 can be configured as a bent part with a collar 704, wherein the collar 704 can be used simultaneously as a carrier for the valve slide 702 and as a retainer for the spring 703. For the retaining function of the spring, on the cylinder 704 a shoulder is formed, which contacts the shoulder 605 of the central screw 109 and has the same height as the shoulder 605. Because the spring contacts not directly on the shoulder 605 of the shaft 110, but instead on a leg of the U-shaped filter 701, the non-return valve 702 together with the filter 701 can be mounted in one piece.

Figure 8:
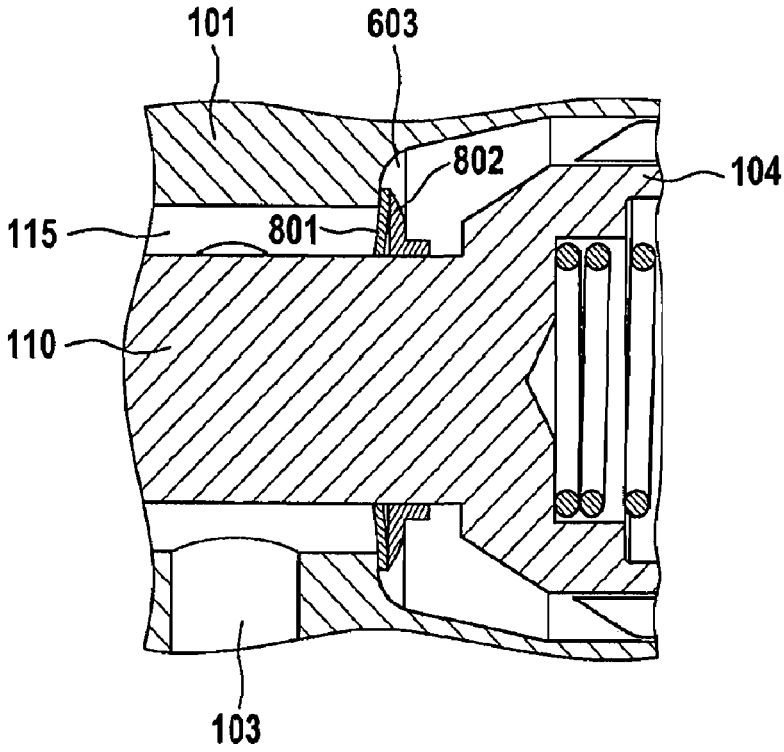
FIG. 8 shows yet another embodiment of a flow resistance element according to another embodiment of the present invention.

FIG. 8 shows another embodiment of a flow resistance element according to one embodiment of the present invention. Here, the one or more flow resistance elements are realized as filters 801 and also as non-return valves 802 in an elastomer configuration. The non-return valve 802 surrounds the shaft 110 with a collar-like configuration in the radial direction and forms a concave sealing lip between the shaft 110 and the camshaft 101.

The outer end of the non-return valve 802 here contacts the ring shoulder 603 of the bore of the camshaft 101. Thus, two chambers of the gap 115 can be mutually separated. For charging of the gap 115 with oil at a certain pressure via the oil supply 103, due to the elastic properties of the elastomer non-return valve 802, the sealing lip of the elastomer non-return valve 802 contacting the step 603 is pressed to the side. The fluid can then flow through the filter 801 and the opened region between the ring shoulder 603 and the sealing lip of the non-return valve 802. The non-return valve 802 is not moved.

If the pressure of the fluid on the side of the non-return valve 802 facing the screw housing 104 increases, so that the fluid flows away from the screw housing, then the sealing lip of the non-return valve 802 is pressed against the shoulder 603. The pressure is supported by the elastic properties of the elastomer material. Here, the sealing lip is pressed against the shoulder 603, in particular, against the filter 801, so that both the openings within the filter 801 and also the entire diameter of the ring gap 115 are sealed.

Thus, the flow of fluid is blocked. The sealing lip of the non-return valve 802 on the OD (outer diameter) forms a seal against the filter edge of the filter 801 or against the surrounding construction, in particular, the bore of the camshaft 101. Due to the elastic properties of the elastomer material, a large tolerance compensation is possible.

Clearly this means that the elastic material can develop the sealing function also for any unevenness, because the elastic sealing lip can lie around this unevenness.

Figure 9:
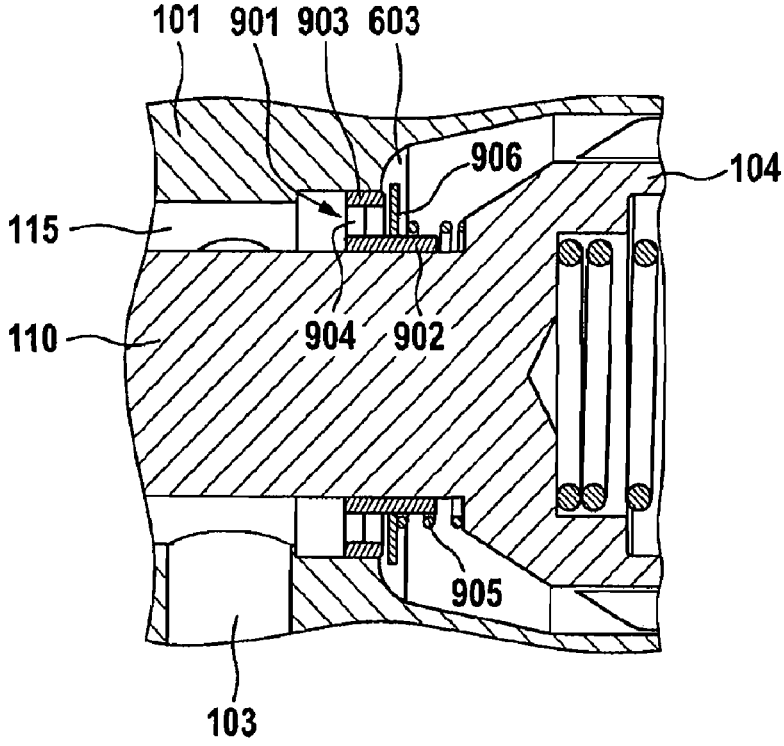
FIG. 9 shows another embodiment of a flow resistance element according to another embodiment of the present invention.

FIG. 9 shows yet another embodiment of a flow resistance element according to one embodiment of the present invention. The filter 901 is a screen carrier with a screen 904, wherein the screen carrier is realized as an insert part in a plastic molded part. The screen carrier is made from an inner collar 902 and an outer collar 903. Here, the inner collar 902 contacts the outer periphery of the screw shaft 110 and the outer collar 903 contacts the inner diameter of the bore of the camshaft 101. Therefore, the gap 115 is sealed relative to the inner diameter of the bore and the outer diameter of the shaft, so that fluid can still pass the circular ring gap 115 only between the inner collar 902 and the outer collar 903.

The inner collar 902 has a cylindrical or tubular configuration. Coaxial to this collar, the outer collar 903 has a cylindrical configuration, wherein the length of the inner collar is greater than the length of the outer collar. The ends of the inner collar and the outer collar facing the oil supply 103 lie in a radial plane. The part of the inner collar projecting past the length of the outer collar can be used as a sliding surface for the non-return valve 906.

The non-return valve 906 is pressed by the spring 905 against the end of the outer collar 903 facing the screw housing 104. Therefore, the flow between the outer collar 903 and inner collar 902 can be stopped. For an oil flow through the filter element 901, the oil must pass the screen 904, wherein contaminants are held back by the screen 904. The inner collar 902 can be used simultaneously as a sliding surface for the non-return valve slide 906, on which this slides. One end of the inner collar 902 can be configured as a stop for the springs 905. Therefore, the flow resistance elements 903, 902, 906, 904 can be replaced in one piece, because no additional stop for the spring is needed.

Figure 10:
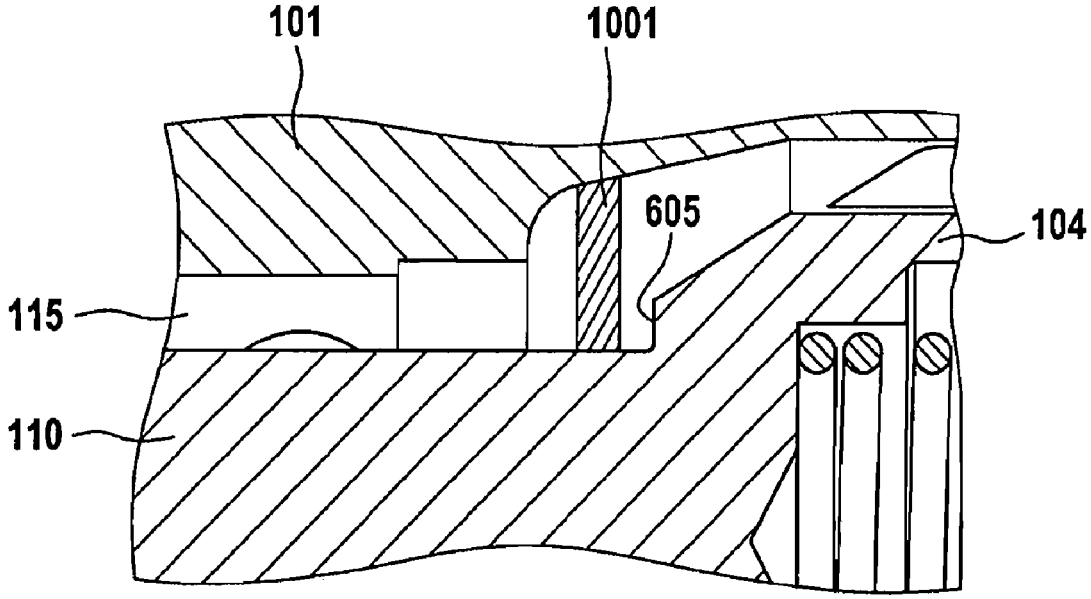
FIG. 10 shows another embodiment of a flow resistance element according to another embodiment of the present invention.

FIG. 10 shows yet another embodiment of a flow resistance element according to one embodiment of the present invention. A flow resistance element 1001, which is shown in FIG. 10, involves a flow-activated non-return valve slide 1001.

In FIG. 10, no filter element is shown. The non-return valve 1001 is arranged on the outer diameter of the shaft 110 movable in the axial direction. The non-return valve slide 1001 extends in the radial direction from the outer diameter of the shaft to the inner diameter of the bore 120 of the camshaft 101. Due to the increase of the inner diameter of the bore 120 of the camshaft 101 in the direction of the screw housing 104, while the outer diameter of the shaft 110 remains constant, a fluid can flow in the channel 115 in the direction of the screw housing 104.

The non-return valve slide 1001 can move in the direction of the screw housing 104 up to the shoulder 605. Here, a gap is created between the outer periphery of the non-return valve slide 1001 and the inner diameter of the bore 120 of the camshaft 101, through which a fluid can flow due to pressurization, not shown in FIG. 10, in the direction of the housing 104.

The closing of the P port 103 or a return flow to the pressurized oil supply 103 is generated only by the flow force of the returning medium. Here, the non-return valve 101 is shifted axis-parallel on the shaft 110.

If the non-return valve 1001 is pressed by the force of the returning medium against the inner periphery of the bore 120 of the camshaft 101, then the gap 115 is sealed.

In addition, it should be noted that "comprising" does not exclude other elements or steps and "a" or "one" does not exclude several elements. It should be further noted that features or steps that have been described with reference to one of the above embodiments could also be used in combination with other features or steps of other embodiments described above. Reference symbols in the claims are not to be viewed as restrictive.

The invention claimed is:

1. Feeder for a camshaft adjuster, comprising:
a central screw,
a camshaft with a bore, and
at least one flow resistance element,
the central screw is arranged at least partially in the bore,
a gap is formed between the central screw and the bore,
the gap is formed to carry a flow of fluid,
the at least one flow resistance element is arranged in the gap in such a way that the at least one flow resistance element prevents a flow of the fluid in one direction,
the central screw has an axis, which defines an axial direction, wherein the at least one flow resistance element is configured to act against a direction of flow of the fluid pointing in the axial direction, and
the at least one flow resistance element is configured to act against the direction of flow of the fluid pointing in the axial direction with a resistance different than a flow direction in an opposite axial direction.

2. Feeder for a camshaft adjuster according to claim 1, wherein the gap is formed as an annular gap.

3. Feeder for a camshaft adjuster according to claim 1, wherein the central screw and the camshaft are formed so that they can rotate opposite each other.

4. Feeder for a camshaft adjuster according to claim 1, wherein the central screw has an outer periphery, and wherein the at least one flow resistance element is arranged on the outer periphery of the central screw.

5. Feeder for a camshaft adjuster according to claim 4, wherein the at least one flow resistance element surrounds the outer periphery of the central screw with a collar-like configuration.

6. Feeder for a camshaft adjuster according to claim 1, wherein the bore has an inner periphery, wherein the at least one flow resistance element is arranged on the inner periphery of the bore.

7. Feeder for a camshaft adjuster according to claim 6, wherein the at least one flow resistance element extends in a radial direction between the inner periphery of the bore and an outer periphery of the central screw.

8. Feeder for a camshaft adjuster according to claim 1, wherein the at least one flow resistance element has a replaceable configuration.

9. Feeder for a camshaft adjuster according to claim 1, wherein the camshaft has a supply opening, wherein the supply opening opens into the bore, in order to charge the gap with the fluid.

10. Feeder for a camshaft adjuster, comprising:
a central screw,
a camshaft with a bore, and
at least one flow resistance element,
the central screw is arranged at least partially in the bore,
a gap is formed between the central screw and the bore,
the gap is formed to carry a flow of fluid,
the at least one flow resistance element is arranged in the gap in such a way that the at least one flow resistance element prevents a flow of the fluid in one direction, and the at least one flow resistance element is configured to function as a non-return valve.

11. Feeder for a camshaft adjuster according to claim 10, wherein the non-return valve comprises an annular slide.

12. Feeder for a camshaft adjuster according to claim 10, wherein the non-return valve comprises a fan-shaped spring.

13. Feeder for a camshaft adjuster according to claim 10, wherein the non-return valve comprises a profiled elastomer.

14. Feeder for a camshaft adjuster according to claim 10, wherein the non-return valve comprises a flow-activated, annular closing body.

15. Feeder for a camshaft adjuster, comprising:
a central screw,
a camshaft with a bore, and
at least one flow resistance element,
the central screw is arranged at least partially in the bore,
a gap is formed between the central screw and the bore,
the gap is formed to carry a flow of fluid,
the at least one flow resistance element is arranged in the gap in such a way that the at least one flow resistance element prevents a flow of the fluid in one direction, and the at least one flow resistance element comprises a filter element.

16. Feeder for a camshaft adjuster according to claim 15, wherein the filter element comprises an annular filter sheet.

17. Feeder for a camshaft adjuster according to claim 15, wherein the filter element comprises a funnel-shaped filter screen.

18. Feeder for a camshaft adjuster according to claim 15, wherein the filter element comprises an annular filter.

19. Feeder for a camshaft adjuster, comprising:
a central screw,
a camshaft with a bore, and
at least one flow resistance element,
the central screw is arranged at least partially in the bore,
a gap is formed between the central screw and the bore,
the gap is formed to carry a flow of fluid,
the at least one flow resistance element is arranged in the gap in such a way that the at least one flow resistance element prevents a flow of the fluid in one direction, and the at least one flow resistance element comprises a non-return valve and a filter element.

* * * * *